United States Patent [19]

Goodman

[11] Patent Number: 4,834,072

[45] Date of Patent: May 30, 1989

[54] DUAL MODE EXERCISE DEVICE

[76] Inventor: Loren M. Goodman, 808 Cypress Blvd., Pompano Beach, Fla. 33069

[21] Appl. No.: 200,290

[22] Filed: May 31, 1988

[51] Int. Cl.[4] ..... A61H 1/02

[52] U.S. Cl. ..... 128/25 R; 128/25 B; 128/70; 272/73; 272/96; 272/134; 272/144

[58] Field of Search ..... 128/25 R, 25 B, 70, 128/71, 72, 73, 74; 272/73, 96, 134, 144

[56] References Cited

U.S. PATENT DOCUMENTS

| | | | |
|---|---|---|---|
| 3,674,017 | 7/1972 | Stefani, Jr. | 128/25 R |
| 3,917,261 | 11/1975 | Small et al. | 128/25 B X |
| 4,477,072 | 10/1984 | DeCloux | 272/73 |
| 4,628,909 | 12/1986 | Tietsworth | 128/25 R |
| 4,717,146 | 1/1988 | Nohara | 272/73 |

*Primary Examiner*—Richard J. Apley
*Assistant Examiner*—Joe H. Cheng
*Attorney, Agent, or Firm*—Berman, Aisenberg & Platt

[57] ABSTRACT

An exercise apparatus is provided wherein two platforms engage separate legs of the user. The platforms are controlled by a drive means which permits operation of the platforms in a plurality of modes. In one mode, the platforms move up and down together, and in a second mode, the platforms move up and down alternatingly. The apparatus may be switched between modes by activating a solenoid which allows a first element to be disengaged from a rotating shaft. Relative movement between the first element and the rotating shaft changes the operation of the exercise apparatus from the first mode to the second mode.

17 Claims, 2 Drawing Sheets

FIG. 1
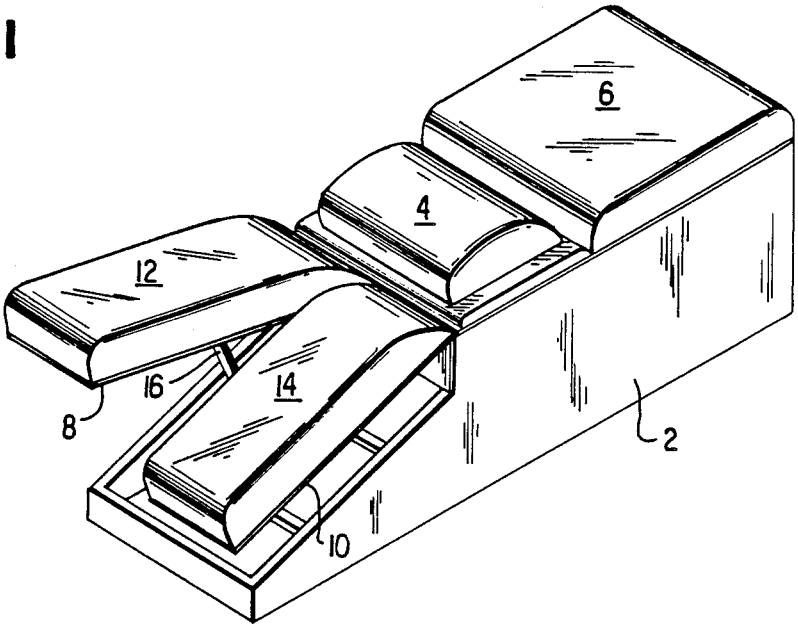
FIG. 2
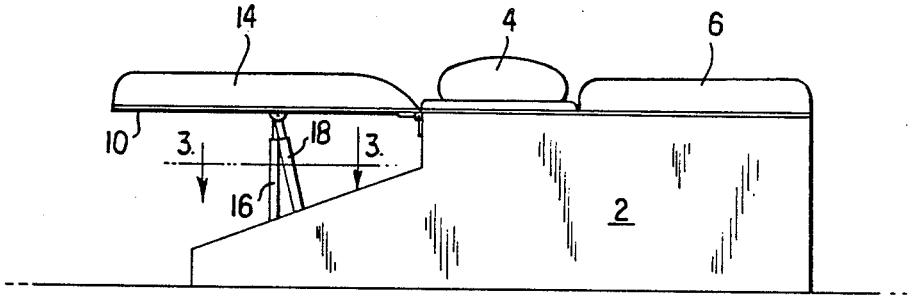
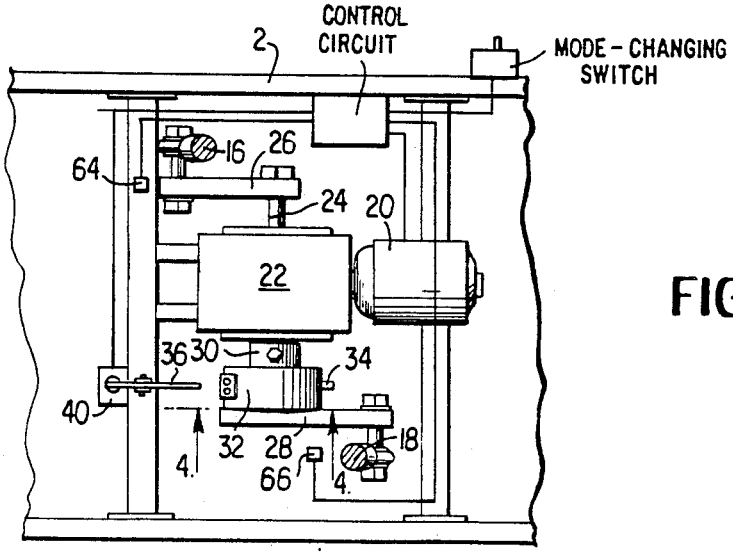
FIG. 3

FIG. 4
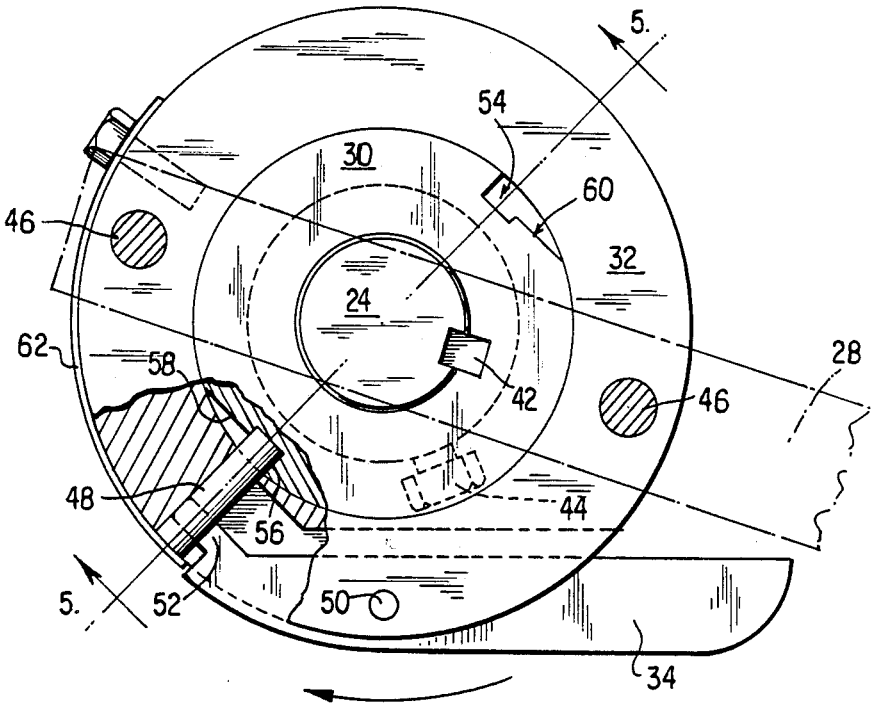
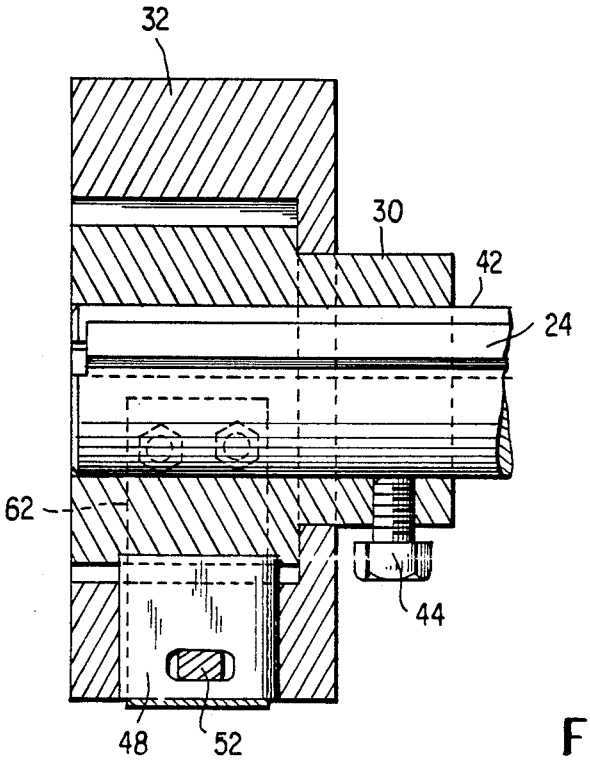
FIG. 5

DUAL MODE EXERCISE DEVICE

TECHNICAL FIELD

The invention relates to the art of passive exercise apparatus and mechanisms for controlling the movement of individual parts of the exercise apparatus.

BACKGROUND ART

Exercise devices are known wherein a user sits or lies on the device such that a movable portion of the device engages and moves a part of the user's body. For example, U.S. Pat. No. 3,674,017 (Stefani) shows an apparatus for passively exercising the abdominal muscles of a user. The apparatus comprises a base having a platform pivotally mounted to the base. The user's torso engages the base, while the legs engage the movable platform. An electric motor drives a shaft which is connected to the pivotal platform for causing the platform to oscillate between substantially horizontal and substantially vertical positions for passively exercising the abdominal muscles of the user.

In the Stefani apparatus, the pivotal platform has a width equal to that of the base such that both legs of the user are raised and lowered in unison.

SUMMARY OF THE INVENTION

It is often desirable to provide exercise for a person's body such that the legs do not rise and fall in unison but are instead alternatingly raised and lowered. Devices known in the prior art are incapable of providing this motion and would require extensive modification to provide it.

In accordance with the invention, a passive exercising device comprises a base having two separate leg-engaging platforms pivotally attached to the base. A drive means pivots the platforms with respect to the base in either of two selected modes. In a first mode, the two platforms rise and fall in conjunction with each other, and in a second mode, the two platforms rise and fall alternatingly. An electronic control system allows the user to select the mode of operation by simple activation of a switch.

In the preferred embodiment, an electric motor drives a transmission (or gear box) which in turn drives a shaft having opposed ends. One end of the shaft has a first arm attached for rotation with the shaft. The first arm is in turn attached to a first of the platforms by a first connecting rod. The other end of the shaft has a mechanism for attaching a second arm to the shaft such that the second arm may assume a selected one of at least two rotational positions with respect to the shaft. The second arm is attached to the second platform by a second connecting rod.

The mechanism preferably includes an inner element and an outer element which rotate with respect to each other to change modes and which are secured to each other in the selected mode. The inner element preferably includes recesses for receiving a pin carried by the outer element. The pinis spring-loaded in the outer element and is controlled by a trip lever. The trip lever is in turn activated by a trip arm controlled by an electronic solenoid. The solenoid is activated by the operator to cause the trip arm to engage the trip lever and allow the inner element to rotate with respect to the outer element to change from one mode of operation to another.

In addition, sensors are provided to detect the angular relationship between the first and second arms, and a simple electronic logic system may be employed to maintain activation of the solenoid until the change in modes has been effected. These sensors are also used to detect when the platforms are horizontal to disable the motor when in this position when the device is turned off.

An object of this invention is to provide an exercise apparatus wherein first and second platforms are attached to a base for selective motion in one of a plurality of modes.

Another object of the invention is to provide a mechanism for permitting an arm attached to a shaft to be selectively positioned rotationally with respect to the shaft.

BRIEF DESCRIPTION OF THE DRAWINGS

FIG. 1 is a perspective of an exercise apparatus in accordance with the invention.

FIG. 2 is a side view of the apparatus shown in FIG. 1.

FIG. 3 is a cross-section along line 3—3 of FIG. 2.

FIG. 4 is a cross-section taken along line 4—4 of 3.

FIG. 5 is a cross-section taken along line 5—5 of FIG. 4.

DETAILED DESCRIPTION OF THE INVENTION

FIG. 1 is a perspective view of an exercise apparatus in accordance with the invention. A base 2 includes pads 4 and 6 for supporting a reclining user. Pivotally attached to base 2 are a first platform 8 and a second platform 10. Platform 8 has a pad 12 thereon for receiving one leg of a user and platform 10 has a pad 14 thereon for receiving a second leg of a user. It will be appreciated that a user may recline on the apparatus shown in FIG. 1 with each leg engaged by one of the platforms 8 or 10.

FIG. 2 is a side view of the inventive apparatus. A first connecting rod 16 is connected between platform 8 and a drive mechanism to be described below and a second connecting rod 18 is connected between platform 10 and the drive mechanism.

FIG. 3 is a cross-section along line 3—3 of FIG. 2 and shows the preferred drive means in more detail. An electric motor 20 is connected to a transmission 22 as is known in the art. Transmission 22 includes a shaft 24 which extends beyond both sides of the transmission case. A first arm 26 is secured to one end of the shaft 24 and is connected to connecting rod 16 for pivoting platform 8 as shaft 24 rotates.

A second arm 28 is attached to an opposite end of shaft 24 by a mechanism which allows selective orientation of arm 28 with respect to shaft 24. That mechanism comprises an inner element 30 which is secured to shaft 24 and an outer element 32 which is selectively positionable with respect to inner element 30. Arm 28 is attached to outer element 32 for rotation therewith, and connecting rod 18 is in turn connected to arm 28 for controlling the motion of platform 10. Outer element 32 includes a trip lever 34 which disengages outer element 32 from a first position and allows it to rotate with respect to inner element 30 to a second position.

It will appreciated that rotation of outer element 32 from a first position to a second position with respect to shaft 24 changes the relative orientation between first and second arms 26 and 28 to thereby change the relative motions of platforms 8 and 10. In the preferred embodiment, outer element 32 is selectively positionable between a first position wherein arms 26 and 28 are oriented 180 degrees with respect to each other as shown in FIG. 3 and a second position wherein arms 26 and 28 are aligned with each other.

A trip arm 36 (see FIG. 3) is pivotally attached to a cross bar 38 which is in turn attached to base 2. One end of trip arm 36 is attached to a solenoid 40 such that activation of the solenoid rotates trip arm 36 from an inactivated position to an activated position. When trip arm 36 is in the activated position, the end of trip arm 36 remote from solenoid 40 engages an end of trip lever 34 as shaft 24 rotates. During the engagement of trip arm 36 and trip lever 34, outer element 32 is disengaged from inner element 30, whereby relative rotation occurs between inner element 30 and outer element 32 to change the relative orientation of arms 26 and 28.

Trip arm 36 is positioned with respect to outer element 32 such that its engagement with trip lever 34 occurs when second arm 28 is in a downward position. This orientation is desirable because the torque on outer element 32 caused by the weight of the user's leg is zero when the arm 28 is pointing downward. Thus, there is no rotation of the outer element 32 caused by the weight of the user's leg when the inner and outer elements are disengaged.

FIG. 4 is a section taken along 4—4 of FIG. 3 and shows the inner and outer elements 30 and 32 in partial cross-section. FIG. 5 is a cross-section taken along line 5—5 of FIG. 4.

Inner element 30 is attached to shaft 24 and is secured to that shaft for fixed rotation with the shaft by a key 42 and set bolt 44. Arm 28 is secured to outer element 32 by bolts 46 whereby the angular relationship between shaft 24 and arm 28 is a function of the angular relationship between shaft 24 and outer element 32.

The angular relationship inner element 30 and outer element 32 is controlled by a pin 48 which is in turn controlled by trip lever 34 which is pivotally attached to outer element 32 at 50. An end 52 of trip lever 34 is received in an opening in pin 48 whereby pivotal rotation of trip lever 34 causes radial movement of pin 48. Inner element 30 has a first recess 54 and a second recess 56. Pin 48 is selectively receivable in either of these recesses to provide two fixed rotational orientations of outer element 32 with respect to inner element 30. A slot of increasing depth 58 leads into recess 56, while a similar slot 60 leads into recess 54.

It will be appreciated that as shaft 24 rotates, outer element 32 rotates therewith, and arm 28 rotates to cause connecting rod 18 to move platform 10. When it is desired to change the mode of operation, the operator activates a circuit including solenoid 40. Solenoid 40 causes a momentary rotation of trip arm 36 such that the end of trip arm 36 remote from solenoid 40 moves upwardly and engages trip lever 34. As trip lever 34 is engaged by trip arm 36, the outer end of lever 34 is depressed thus causing end 52 to move pin 48 radially outwardly. This disengages pin 48 from recess 56 and allows inner element 30 to rotate with respect to outer element 32. As inner element 30 moves with respect to outer element 32 in response to continued rotation of shaft 24, spring 62 urges pin 48 radially inwardly such that pin 48 slides down slot 60 and is received in recess 54. This sequence of steps causes outer element 32 to rotate 180 degrees with respect to inner element 30, thus changing the mode of pivotal operation of the platforms 8 and 10.

It will be appreciated that more than two recesses may be provided in inner element 30, if so desired.

With reference to FIG. 3, a first proximity sensor 64 detects the angular orientation of arm 26. A second proximity sensor 66 provides similar information with respect to arm 28. In a preferred embodiment, an electronic circuit having a holding coil in series with at least one of the sensors provides repeated activation of solenoid 40 in response to the user's actuation of a mode-changing switch until signals emanating from sensors 64 and 66 indicate that the desired change in modes has been effected. It will be appreciated by those of skill in the art that such a circuit is easily provided.

Also, sensors 64 and 66 supply signals to a circuit to determine when the platforms are horizontal and to stop the motor at that point. This circuit includes a holding coil in series with the proximity sensors and the motor so that when the system is to be shut down, motor 20 begins a reduced velocity mode until the proximity sensors stop the motor. This process removes the possibility of an overshoot of the horizontal positions of the platforms.

It will be appreciated that a unique exercise apparatus and mechanism therefore has been described. Modification within the scope of the appended claims will be apparent to those of skill in the art.

I claim:

1. Exercise apparatus comprising a base, first and second platforms attached to said base for engaging parts of the body of a user, and drive means for moving said platforms with respect to said base, wherein said drive means comprises means for causing said platforms to move with respect to said base in a selected one of at least two modes, and wherein said platforms move in conjunction away from said base or toward said base in a first of said modes and move alternatingly away from said base or toward said base in a second of said modes.

2. Exercise apparatus according to claim 1 wherein said drive means comprises a rotating shaft, first arm means attached to said shaft for rotation therewith and attached to said first platform for pivoting said first platform, and second arm means attached to said shaft for rotation therewith and attached to said second platform for pivoting said second platform, and wherein said second arm means comprises means for selectively positioning said second arm means with respect to said shaft.

3. Exercise apparatus according to claim 2 wherein said means for selectively positioning comprises an inner element attached to said shaft and an outer element rotatable with respect to said inner element.

4. Exercise apparatus according to claim 3 wherein said inner element comprises first and second stop means and said outer element comprises pin means, said pin means is selectively engaged with one of said first and second stop means for securing said outer element to said inner element in a selected position.

5. Exercise apparatus according to claim 4 wherein said pin means comprises an elongate pin, and each of said first and second step means comprises a recess in said inner element.

6. Exercise apparatus according to claim 5 wherein each of said first and second stop means further comprises a slot having a depth which increases in a direction toward said recess for guiding said pin into said recess.

7. Exercise apparatus according to claim 6 further comprising trip lever means pivotally attached to said outer element and having first and second opposed ends, said first end engaging said pin, and said second end extending outwardly from said outer element to be selectively engaged by a trip arm arm mounted on said base.

8. Exercise apparatus according to claim 4 further comprising actuation means mounted on said base for disengaging said pin means from one of said first and second stop means.

9. Exercise apparatus according to claim 8 wherein said actuation means disengages said pin means when the torque on said outer element caused by the weight of one of said parts of the body of the user is small.

10. Exercise apparatus according to claim 8 wherein said actuation means comprises an electrically activated trip arm.

11. Exercise apparatus according to claim 10 wherein said trip arm is actuated by an electronic solenoid.

12. Exercise apparatus according to claim 11 wherein said pin means comprises a trip lever for disengaging said pin means from said selectively engaged stop means when said trip lever is engaged by said trip arm.

13. Exercise apparatus according to claim 12 further comprising sensing means for sensing the relative positions of said first and second arm means.

14. Apparatus for selectively positioning an arm with respect to a shaft comprising an inner element for being attached to said shaft and an outer element surrounding said inner element for having said arm attached thereto, wherein said inner element comprises first and second stop means and said outer element comprises pin means, said pin means is selectively received in one of said first and second stop means for securing said outer element to said inner element in a selected position.

15. Apparatus according to claim 14 wherein said pin means comprises an elongate pin, and each of said first and second stop means comprises a recess in said inner element.

16. Apparatus according to claim 15 wherein each of said first and second stop means further comprises a slot having a depth which increases in a direction toward said recess for guiding said pin into said recess.

17. Apparatus according to claim 16 further comprising trip lever means pivotally attached to said outer element and having first and second opposed ends, said first end engaging said pin, and said second end extending outwardly from said outer element to be selectively engaged by a trip arm.

* * * * *